US005807126A

United States Patent [19]

Bethurum

[11] Patent Number: 5,807,126

[45] Date of Patent: Sep. 15, 1998

[54] LOW PROFILE CONNECTOR SYSTEM

[75] Inventor: Gary Cain Bethurum, Laguna Niguel, Calif.

[73] Assignee: ITT Industries, Inc., White Plains, N.Y.

[21] Appl. No.: 741,758

[22] Filed: Nov. 5, 1996

[51] Int. Cl.[6] ..... H01R 13/15

[52] U.S. Cl. ..... 439/259; 439/79

[58] Field of Search ..... 439/259, 260, 439/578–582, 79, 83

[56] References Cited

U.S. PATENT DOCUMENTS

| | | | |
|---|---|---|---|
| 2,857,577 | 10/1958 | Vanderpool . | |
| 3,217,285 | 11/1965 | Barre . | |
| 3,436,715 | 4/1969 | Matthews . | |
| 3,474,387 | 10/1969 | Krum et al. . | |
| 3,912,353 | 10/1975 | Kasuya et al. . | |
| 4,017,696 | 4/1977 | Falk | 179/175 |
| 4,542,950 | 9/1985 | Gillett et al. . | |
| 4,550,959 | 11/1985 | Grabbe et al. . | |
| 4,623,207 | 11/1986 | Sasaki et al. . | |
| 4,640,562 | 2/1987 | Shoemaker . | |
| 4,648,668 | 3/1987 | Sinisi . | |
| 4,768,971 | 9/1988 | Simpson | 439/329 |
| 4,776,803 | 10/1988 | Pretchel et al. | 439/59 |
| 4,919,626 | 4/1990 | Anhalt et al. | 439/260 |
| 5,013,247 | 5/1991 | Watson | 439/55 |
| 5,015,197 | 5/1991 | Redmond et al. | 439/329 |
| 5,035,641 | 7/1991 | Van-Santbrink et al. | 439/329 |
| 5,176,535 | 1/1993 | Redmond et al. | 439/495 |
| 5,190,461 | 3/1993 | Oorui et al. | 439/63 |
| 5,271,740 | 12/1993 | Endo et al. | 439/260 X |
| 5,383,788 | 1/1995 | Spencer | 439/67 |
| 5,391,089 | 2/1995 | Quickel et al. | 439/260 |

*Primary Examiner*—Khiem Nguyen
*Attorney, Agent, or Firm*—Thomas L. Peterson

[57] ABSTRACT

A connector system includes a receptacle that is small and assures precise alignment of mating contacts and terminals. The receptacle includes a circuit board (32) with a laterally-extending row of traces (42), and a receptacle housing (36) with a top wall (44) lying above the traces to form a cavity (16) between them. A plug front portion has a row of contacts (60) for entering the cavity and engaging the traces. The top wall has a row of cam surfaces (120) while the plug contacts have front portions with cam follower locations (112) that slide down along the cam surfaces. This causes trace-engaging locations (114) on the contacts to move down against the traces. The top wall has a row of downwardly-projecting ribs (72) that form the cam surfaces. The plug housing (62) has a row of separators that fit into the spaces between the ribs. The plug has a coax section (230) that includes a pair of laterally-spaced grounded contacts (246, 248), a signal contact (260) with its front portion (262) lying between the grounded contacts, and a grounded tine (264) that lies under the signal contact.

26 Claims, 5 Drawing Sheets

72
74
36
57
152
56
161
156
64
150
160
154
32
M
L
F
R 198
192
188A
188
190
184
180
194
174
176
170
186
172
172A
182A
182
U
F
R
D 202
204
216
205
201
200
A
212
203
206
210
214
F
R
D

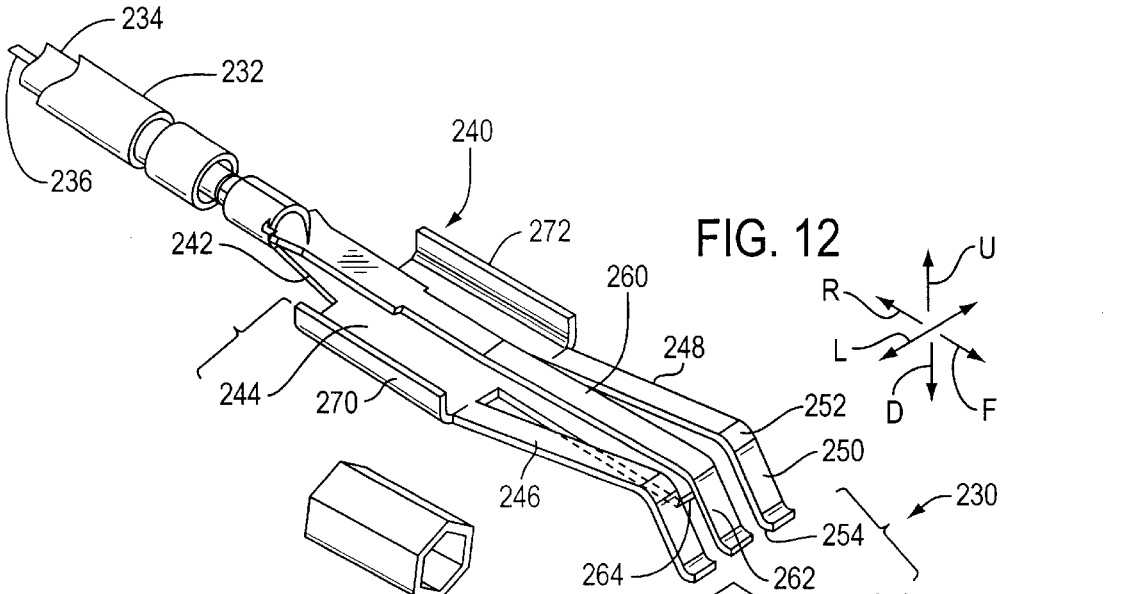
FIG. 12
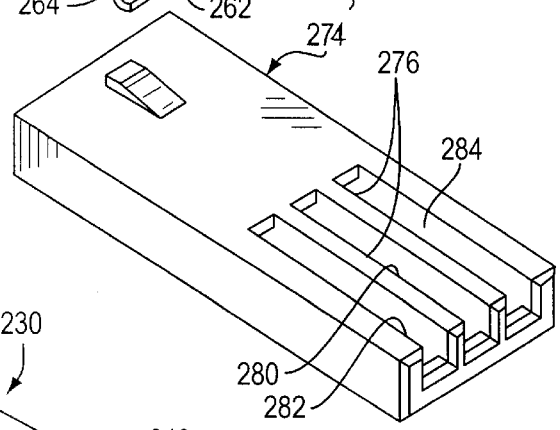
FIG. 14
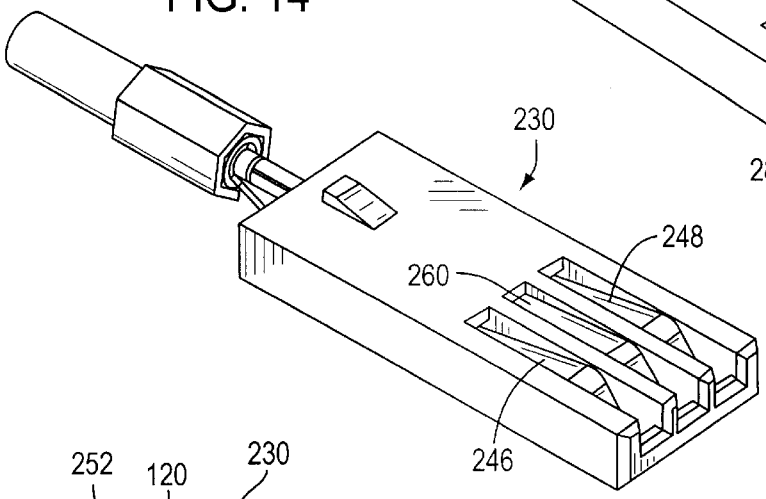
FIG. 15
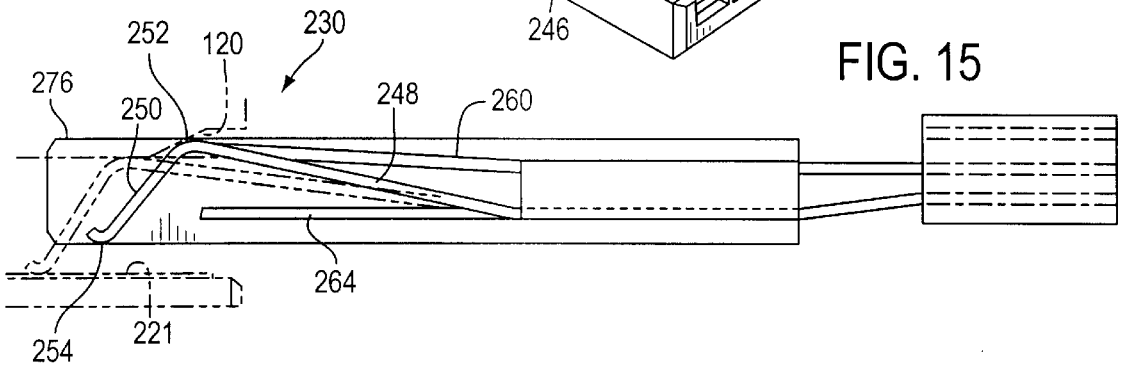

LOW PROFILE CONNECTOR SYSTEM

BACKGROUND OF THE INVENTION

Presently, portable cellular telephones are provided with a small opening leading to a receptacle connector, or receptacle, with receptacle contacts having tails that are soldered to traces on a circuit board in the telephone. As the portable telephones become smaller, less space is available for the receptacle and very small contacts are used. In practice, it is found difficult to precisely locate the receptacle contact tails on the circuit board traces, due to shifting during connector part manufacture and later end user final assembly. The area around the receptacle opening varies according to different telephone manufacturers who buy the same receptacle, so all alignment of the plug with the receptacle is accomplished by surfaces of the plug that fit into the cavity of the receptacle. A connector system which minimized the height and depth of the space required for the receptacle and which minimized its cost while assuring precision location of contacting surfaces, would be of value.

SUMMARY OF THE INVENTION

In accordance with one embodiment of the present invention, a connector system is provided that enables the receptacle connector to have a small height and depth and that facilitates precision positioning of the receptacle terminals. The receptacle connector includes a circuit board with an upper face and a laterally-extending row of traces on the upper face. A receptacle housing has a top wall lying above the upper face to form a cavity between the top wall and the circuit board. The plug connector includes a plug housing with a front portion that fits completely within the cavity, and with a laterally-extending row of plug contacts for engaging the circuit board traces. The receptacle housing top wall has a laterally-extending row of cam surfaces that are each positioned to engage a cam-follower location on a plug contact to depress the contact until a trace-engaging location on the contact engages a trace. The cam-follower location of each contact does not engage the cam surface until after the contact has entered substantially into the cavity.

The receptacle housing top wall has a plurality of downwardly-projecting ribs whose lower surfaces form the cam surfaces, with the ribs being spaced apart to form slots. The plug housing includes a row of plate-like separators which separate the plug contacts and which fit into the slots between the ribs. Precision lateral alignment of the plug and receptacle is obtained by engagement of the separators with walls of the slots.

A coax arrangement on the plug includes a ground conductor comprising a pair of laterally-spaced ground contacts. A signal contact has a front portion that lies laterally between the front portions of the ground contacts, and all three contacts can be deflected downwardly against corresponding traces on the circuit board. The ground conductor also includes a grounded tine that lies directly under the signal contact but which does not extend as far forwardly to avoid directly engaging the signal contact.

The novel features of the invention are set forth with particularity in the appended claims. The invention will be best understood from the following description when read in conjunction with the accompanying drawings.

BRIEF DESCRIPTION OF THE DRAWINGS

FIG. 12 is an exploded rear isometric view of the coax assembly of the plug connector of FIG. 2.

FIG. 14 is a rear isometric view similar to that of FIG. 12, but with the parts assembled.

FIG. 15 is a side elevation view of the coax assembly of FIGS. 12–14, showing the contact front portions as they first encounter a receptacle cam surface during mating, and showing in phantom lines a contact in a fully inserted and mated position.

DESCRIPTION OF THE PREFERRED EMBODIMENT

Figure 1:
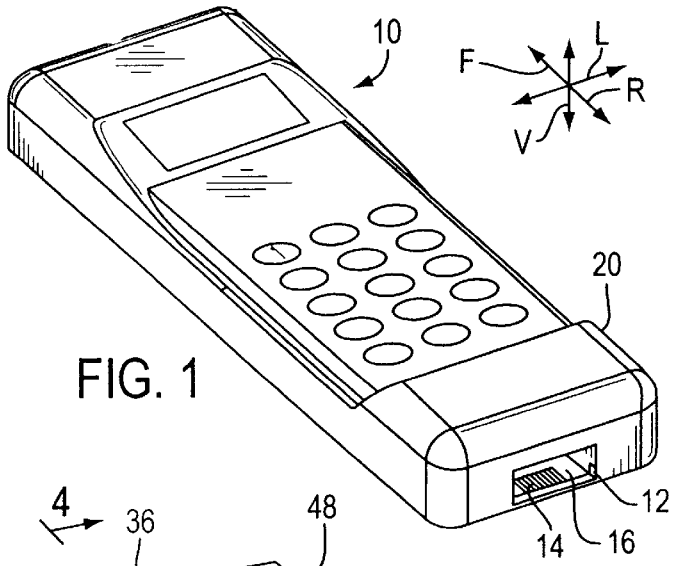
FIG. 1 is an isometric view of a portable cellular telephone, showing the receptacle connector of the present invention.

FIG. 1 illustrates a portable cellular telephone 10 which has a receptacle connector 12 with a row 14 of terminals for mating with contacts of a plug connector, by insertion of the plug connector into a cavity 16 of the receptacle connector. The width in a lateral direction L is determined to a large extent by the size and number of terminals in the row 14. The height in a vertical direction V and the depth in forward and rearward directions F, R of the receptacle connector should be as small as possible in order to allow room for circuitry in the telephone. This is especially so as portable telephones become smaller. The receptacle connector 12 is manufactured by a connector manufacturer, for a telephone manufacturer who assembles the receptacle connector to a circuit board of the telephone. The telephone manufacturer designs the size and shape of the telephone molded casing 20, which may vary from one telephone manufacturer to the other. For this reason, the front portion of the mating plug connector should fit solely into the cavity 16, and not include any portion that attempts to surround the telephone casing 20.

Figure 2:
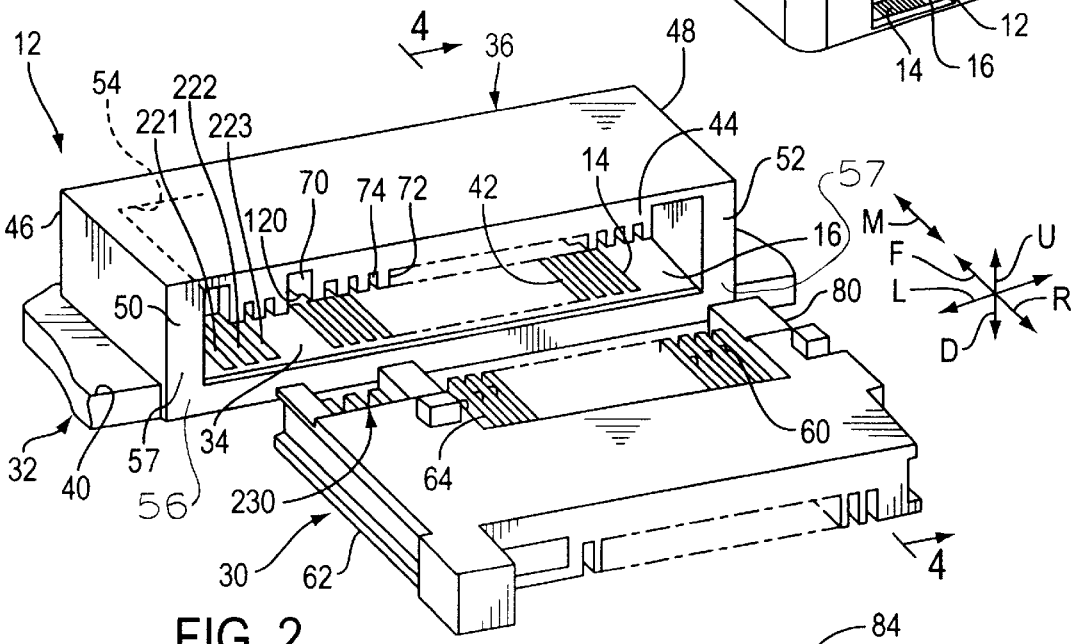
FIG. 2 is an exploded isometric view of a connector system of the present invention, showing plug and receptacle connectors thereof.

FIG. 2 shows greater details of the receptacle connector 12 and of a mating plug connector 30. The receptacle connector includes a circuit board 32 and particularly an edge section 34 of the circuit board, which lies under a receptacle housing 36. The circuit board has an upper face 40 and has a plurality of electrically conductive traces 42 thereon arranged in the row 14. The receptacle housing 36 has a top wall 44 lying a distance above the traces 42, and having laterally-spaced opposite top wall sides 46, 48 with side walls 50, 52 thereat that rest on the circuit board. The housing also can be provided with a front wall 54, and with a rear lip 56 extending between the front lower portion 57 of the side walls 46, 48 to lie over the rear edge of the circuit board. The lip is thin, with a longitudinal (M) thickness no more than the minimum height (A) of the cavity that receives the contacts.

The plug connector 30 has a row of plug contacts 60 which are designed to engage the row of traces 42 when the connectors mate. The plug connector has a plug housing 62 with a laterally-extending row of plate-like separators 64 that separate the plug contacts 60.

The top wall 44 of the receptacle housing has a laterally-extending row 70 of downwardly-extending ribs 72. The ribs are laterally spaced apart to leave slots 74 between them. The plate-like separators 64 are designed to fit into the slots 74 as the connectors mate. The engagement of the separators 64 in the slots 74, are preferably relied upon to precisely locate the connectors in the lateral direction L, to assure that each plug contact 60 engages only a predetermined one of the terminals formed by the traces 42. It is noted that the terminals formed by the traces 42 extend to other circuitry on the circuit board and to electrical components on the board.

Figure 3:
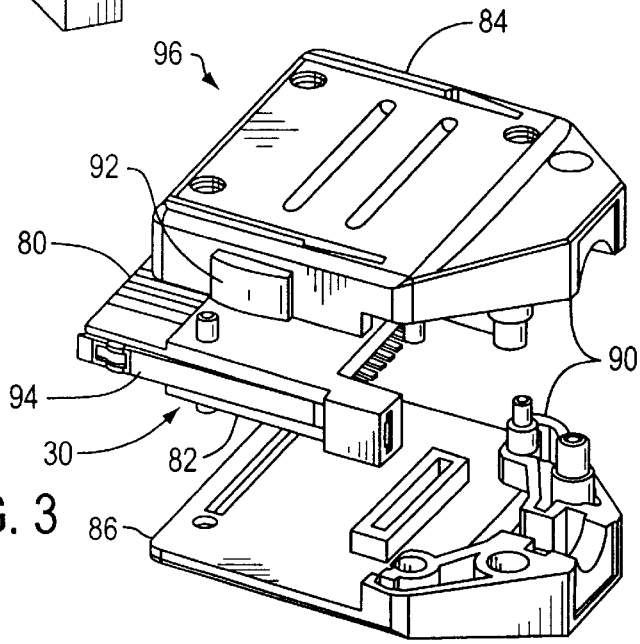
FIG. 3 is an exploded isometric view showing the plug connector of FIG. 2, and showing a clam shell assembly for protecting the plug connector.

FIG. 3 shows that the plug connector 30 has a front end portion 80 that is designed to be received in the cavity of the receptacle connector, and has a rear portion 82 that can be protected by upper and lower clam shells 84, 86 of a clam shell assembly 90. The clam shell assembly includes a latch actuator 92 that can operate a latch strip 94 to latch a plug connector assembly 96 that includes the plug connector 30, to the receptacle connector 12. The clam shell assembly 90, latch actuator 92, and latch strip 94 are known in the prior art, and are not discussed in detail herein.

Figure 4:
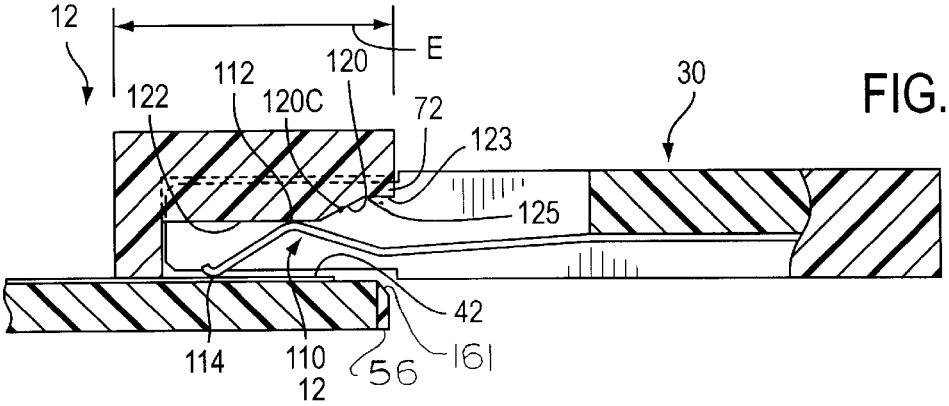
FIG. 4 is a view taken on line 4—4 of FIG. 2, but with the plug end receptacle connectors fully mated.
Figure 5:
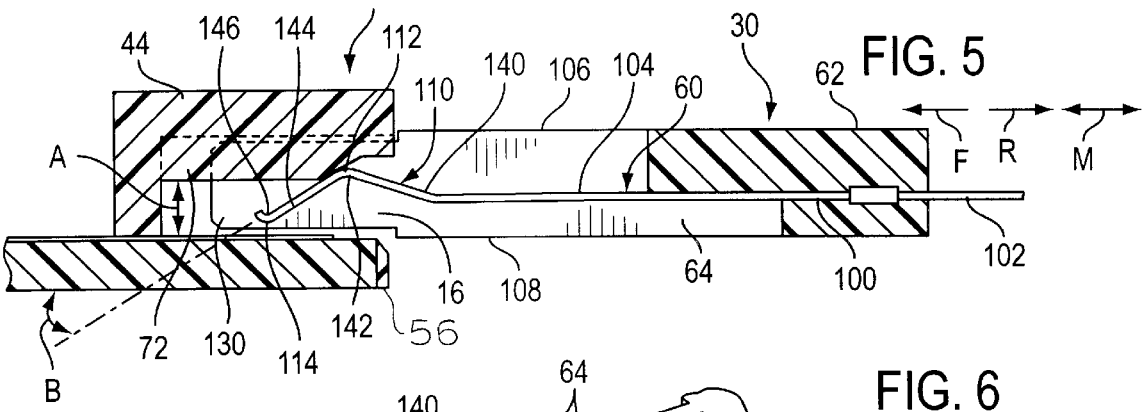
FIG. 5 is a view similar to that of FIG. 4, but with the plug connector inserted only far enough that the plug contacts first engage cam surfaces of the receptacle.

FIG. 5 shows the plug connector 30 after it has been moved in a forward direction F (which is parallel to a longitudinal direction M) far enough to only partially mate with the receptacle connector 12. The plug contact 60 is formed from a metal strip such as a plated copper alloy strip that has been bent. The contact has a rear portion 100 that is fixed to the plug housing 62 as by molding it in place. The contact rear portion is shown in a simplified view wherein it is crimped to a cable wire 102, although this is well known in the prior art. The contact has a middle portion 104 that extends primarily horizontally, to lie between the top and bottom 106, 108 of the separators 64. The contact has a front portion 110 which is the portion that enters the receptacle connector cavity 16 in the fully mated positions of the connectors. The front portion includes an upper cam-follower location 112 which can be depressed, and a lower trace-engaging location 114 which engages a receptacle terminal formed by a circuit board trace. As also shown in FIG. 4, the ribs 72 of the receptacle top wall form cam locations, or cam surfaces 120 that are designed to engage the cam follower locations 112 of the plug contacts as the contacts are inserted. The ribs also form substantially horizontal holdown surfaces 122 that engage the cam follower location 112 after the contacts have been fully mated as in FIG. 4. The ribs have substantially horizontal rear end surfaces 123 that extend rearwardly from the upper ends 125 of the cam surfaces.

When the plug connector 30 is moved in the forward direction F to mate with the receptacle connector, lead-ins 130 formed by front ends of the separators 64 and by opposite sides of the plug connector housing, initially align the connectors. Precision alignment is preferably accomplished by the front ends of the separators 64 entering into the slots between the ribs on the top wall of the receptacle housing. Further forward movement of the plug connector results in the cam follower location 112 of the contacts initially engaging the cam surfaces 120 at the position shown in FIG. 5. The cam surfaces 120 extend at downward-forward inclines, resulting in the cam follower locations 112 moving downwardly as they move forwardly. The cam surfaces are of low friction material. The trace-engaging locations 114 of the contacts also move downwardly until they engage the traces 42. To assure low electrical resistance engagement of the contact locations 114 with the traces, the contacts are depressed and slightly bent when they move from the position of FIG. 5 to the position of FIG. 4.

Each contact front portion 110 includes a rearward first part 140 that merges with the contact middle portion 104, with the first part extending at a forward-upward incline. The forward portion has a second part 142 at the front end of the first part, with the second part 142 forming a bend, preferably at an obtuse angle, and with the upper surface of the bend being convex and forming the cam follower location 112. The contact front portion includes a third part 144 that extends at a forward-downward incline from the second part, to a fourth part 146 that has a bend with a convex lower surface that forms the trace-engaging location 114. The angle B of the third part 144 with a horizontal direction determines, to some extent, the required depth E in the forward-rearward directions F, R of the receptacle. Applicant prefers that the angle B be at least 20° to limit the depth of the receptacle connector and to assure a firm downward force of the trace-engaging location 114 against the circuit board trace. Applicant prefers an angle 13 of about 30° to provide moderate resilience. The cam surface 120 preferably extends at a slightly greater angle of incline to the horizontal than angle B, in order to engage the middle of the contact second part 142. The cam surface 120 is positioned so the center 120 C along its length as seen in FIG. 4, initially engages the cam follower location 112, to engage such locations for contacts that are slightly higher or lower than the designed height. When the connectors are fully mated, the contacts achieve the positions shown in FIG. 4, with the cam follower locations 112 being pressed down by the holdown surfaces 122 while the locations 112 engage the circuit board traces.

Figure 6:
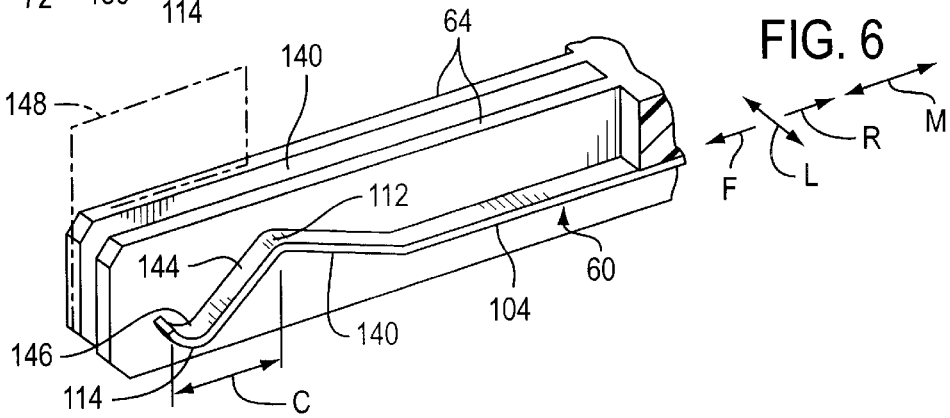
FIG. 6 is a partial isometric view of the plug of FIG. 5, showing a plug contact and a pair of separators.
Figure 7:
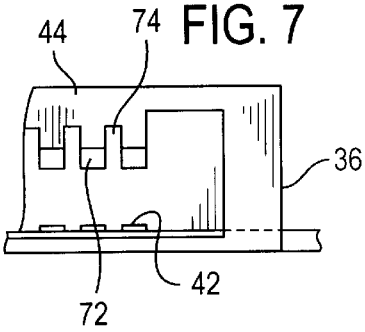
FIG. 7 is a partial front elevation view of the receptacle of FIG. 2.
Figure 8:
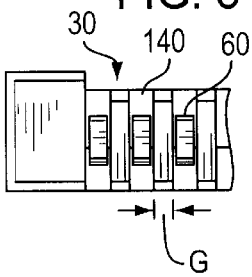
FIG. 8 is a partial rear elevation view of the front end of the plug connector of FIG. 2.

As shown in FIG. 6, the separators 64 lie in planes such as 148 that extend geometrically normal to the lateral direction L. The separators are laterally spaced apart to leave gaps 140 between them, in which the contacts 60 lie. Applicant prefers that the lateral position of the plug connector be determined by the engagement of the separators 64 with the walls of the slots 74 (FIG. 7) in the receptacle housing top wall 44. Each gap 140 and the contact 60 therein lies directly under one of the top wall ribs 72. Lateral location by means of separators engaging walls of the top wall slots, assures precision alignment. The lateral width G of each separator is considerably less than the width of each slot 74 to allow all separators to enter all slots despite tolerances. Of course, it is also necessary that the receptacle housing 36 be mounted with precision on the circuit board, to assure that each rib 72 lies directly over a corresponding trace 42.

Figure 9:
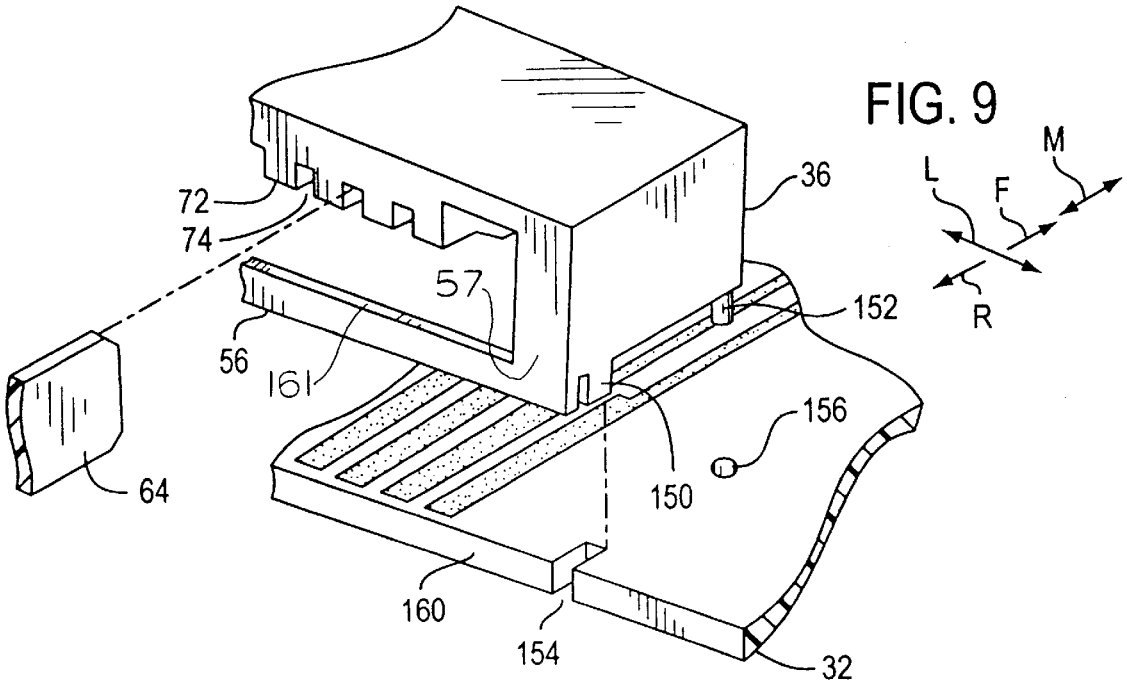
FIG. 9 is an exploded partial isometric view of the receptacle housing and circuit board of the receptacle connector of FIG. 2.

FIG. 9 shows that the receptacle housing 36 is provided with downwardly-projecting posts 150, 152 that are closely received in holes 154, 156 formed in the circuit board 32. It is noted that the hole 154 at the rear edge of the circuit board is in the form of a slot, with the post 150 being very closely laterally positioned within the slot 154. The forward post 152 does not need to provide as accurate an alignment. It is noted that the lip 56 is provided to cover the rear edge 160 of the circuit board, to provide a bevel 161 (FIG. 4) therein for plug insertion, and to provide a surface that is smooth as compared to a possibly rough cut surface of a circuit board.

Figure 10:
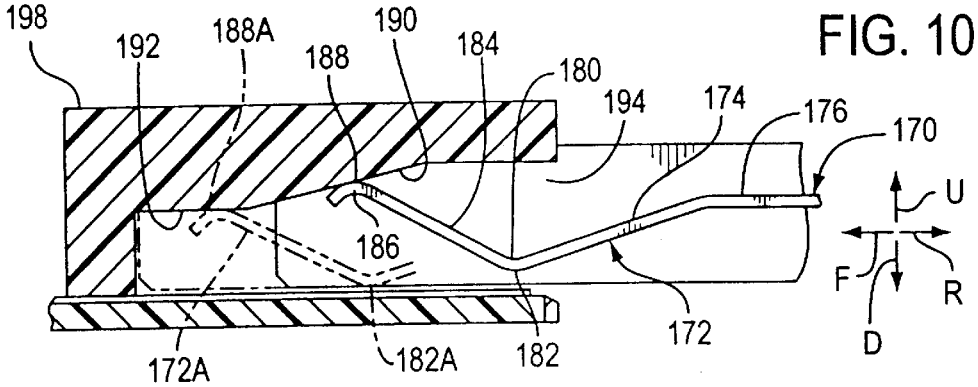
FIG. 10 is a partial sectional side view similar to that of FIG. 5, but showing a plug connector of another embodiment of the invention, and with a corresponding receptacle.

FIG. 10 illustrates another form of contact 170 with a differently formed front portion 172. The front portion 172 includes a first part 174 that extends at a forward-downward incline from a contact middle portion 176. A second part 180 forms a bend with a convex lower surface forming a trace-engaging location 182. A third part 184 extends at a forward-upward incline, to a fourth part 186. The fourth part 186 forms a bend with a convex upper surface forming a cam follower location 188. FIG. 10 shows, in solid lines, the cam follower location 188 when it first engages a cam surface 190. FIG. 10 also shows, in phantom lines, the contact front portion at 172A in the fully inserted position, wherein the trace-engaging location at 182A engages the trace and the cam follower location at 188A engages a holdown surface 192. The contact of FIG. 10 has an advantage in that the cam follower location 188 is forward of trace-engaging location 182 (which must be kept clean for low resistance contact and which is protected by lying more rearward). However, the contact of FIG. 10 requires a considerably longer (in forward-rearward directions) receptacle housing 198.

Figure 11:
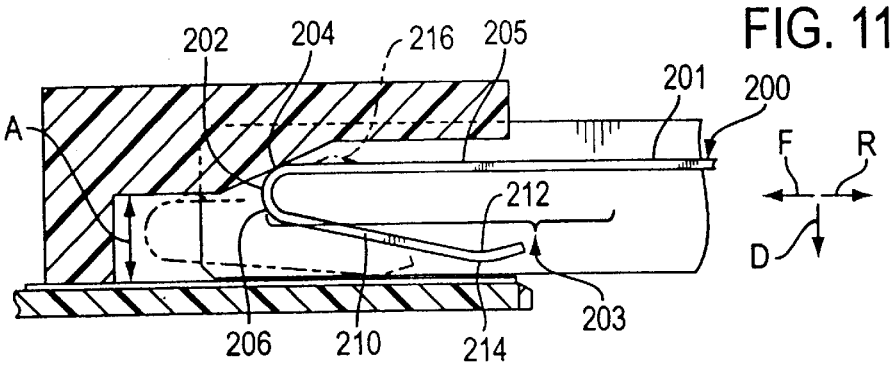
FIG. 11 is a view similar to that of FIG. 10, but showing a plug connector of still another embodiment of the invention and a corresponding receptacle.
Figure 13:
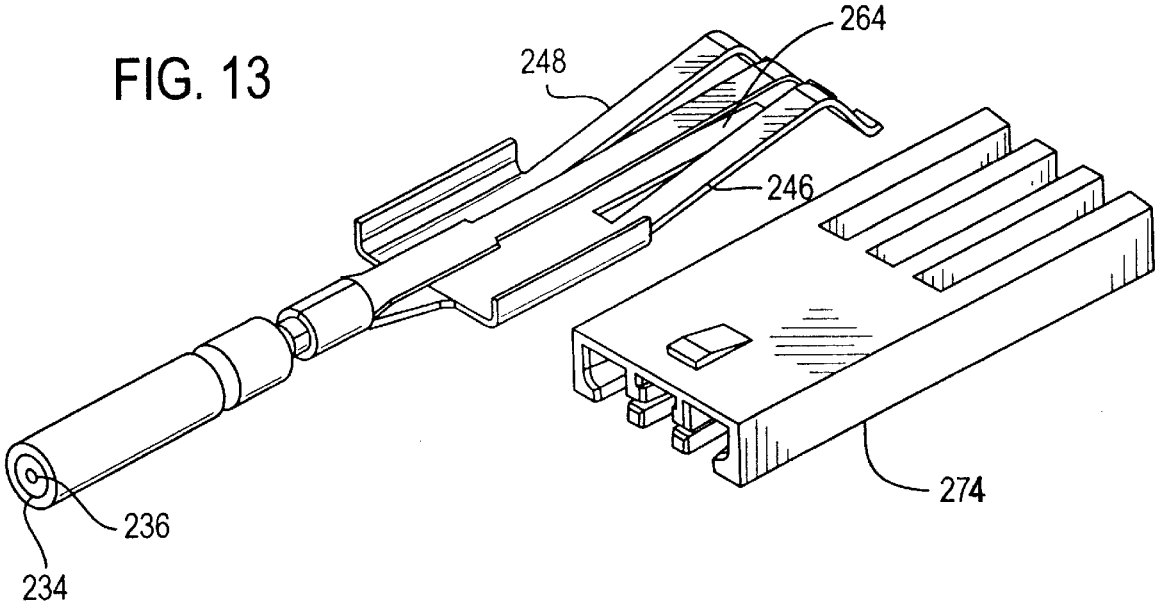
FIG. 13 is an exploded front isometric view of the coax assembly of FIG. 12.

FIG. 11 shows another contact 200 which has a primarily horizontal middle portion 201 whose front merges with a front portion 203 (the portion that finally enters the receptacle cavity) of the contact. The contact front portion has a primarily and substantially horizontal first part 205, and has a second part 202 extending in about a 170° loop, with the upper part of the loop at 204 extending largely horizontally and forming a cam-follower location. The lower end 206 of the loop extends at about a 10° incline (less than 60° and preferably less than 40°) from the horizontal. The contact front portion also has a third part 210 that extends at a rearward-downward incline to a fourth part 212 that has a bend with a convex lower surface 214 forming a trace-engaging location. Applicant's analysis shows that the contact of FIG. 11 undergoes the least stress in mating, and would be preferred except for the cost. The contact 200 is more expensive to construct because of the large bending at the loop 202. More predicable contact deflection is achieved by providing an upward bump such as at 216 at or slightly rearward (less than the height A of the rear of the cavity) of the top of the loop.

FIG. 2 shows that one side of the receptacle connector 12 includes three circuit board traces 221–223 that are separated from the other traces 42, while the plug connector 30 also has a separate coax section 230 at one side. The plug coax section 230 is constructed to connect to a shielded contact arrangement (usually a coaxial cable, but possibly a strip line or the like) while the three circuit board traces 221–223 are designed to mate to contacts of the coax section. It is noted that the traces 221 and 223 are grounded, while the trace 222 is intended to carry high frequency signals. Referring to FIGS. 12–15, it can be seen that the coax section 230 of the plug connector is designed to be connected to a coaxial cable 232 of the usual type that includes a grounded outer conductor 234 (which is covered by a protective jacket) and a signal-carrying inner conductor 236.

The grounded outer conductor 234 is connected to a ground conductor arrangement 240 which includes a tab 242 extending to a ground plate portion 244, and a pair of laterally-spaced ground contacts 246, 248 that project forwardly from the ground plate portion. The tab 242, plate portion 244 and contacts 246, 248 are integral. Each of the ground contacts 246, 248 have front portions 250 with cam follower locations 252 that are designed to be downwardly deflected by a cam surface The front portions each have a trace-engaging location 254 that is designed to engage one of the ground traces 221, 223 of the receptacle connector. The coax section also includes a middle or signal contact 260 that is connected to the inner conductor 236 of the coaxial cable and which extends forwardly therefrom. The signal contact 260 extends over the ground plate portion 244 and between the ground contacts 246, 248. A front portion 262 of the signal contact lies between the front portions 250 of the ground contacts.

The ground conductor arrangement 240 includes a grounded tine 264 that extends forwardly from the ground plate portion 244, and which lies under the signal contact 260. The tine 264 provides a ground plane under the elongated portion of the signal contact that extends forwardly of the ground plane portion 244, just as the ground plane portion 244 and tab 242 lie closely under more rearward portions of the signal contact. By providing a ground plane closely under the signal contact, applicant maintains the characteristic impedance of the coaxial arrangement, while also helping to protect the signal contact 60 from stray electromagnetic radiation. The presence of the ground conductors 246, 248 on laterally opposite sides of the signal contact, also aids in maintaining characteristic impedance and avoiding stray signals. This is further enhanced by providing a pair of upstanding flanges 270, 272 on laterally opposite sides of the ground plane portion 244.

The signal contact 260 and ground conductor arrangement 240 are mounted in a dielectric coax frame 274 which has forward walls forming a group of locating spacers 276 that are similar to the spacers 64 described in the connection with FIG. 2. The spacers form a middle coax gap 280 that holds the front portion of the signal contact and a pair of side coax gaps 282, 284 that hold the front portions of the ground contacts. It is noted that the term "coax" does not refer solely to a coaxial arrangement, but to a shielding arrangement that can connect to a coaxial cable.

FIG. 15 shows the manner in which the cam follower 252 of a ground conductor front portion 250 is downwardly deflected by a cam surface 120 until the trace-engaging location 254 engages a grounded trace such as 221, during mating of the plug and receptacle connectors.

In a connector system that applicant has designed, the area of the circuit board, or edge section 34 (FIG. 2) available for holding the receptacle housing 36, was only 25 millimeters wide (in direction L) and 10 millimeters deep (in directions F, R). The available height above the circuit board face 40 was only 5 millimeters. The traces 42 were spaced (center-to-center) by only one millimeter. It can be appreciated that precision assembly is required to assure that all contacts engage only a single selected circuit board trace.

Although terms such as "top", "horizontal", "down", etc have been used to help in describing the invention as illustrated, it should be understood that the system and its parts can be used in any orientation with respect to the Earth.

Thus, the invention provides a connector system wherein the receptacle connector has a small depth and height, the receptacle connector can be precisely constructed at low cost, and the plug and receptacle connectors can be mated with no part of the plug connector required to surround the receptacle connector. The receptacle connector includes a circuit board with a row of traces thereon and also includes a receptacle housing having a top wall lying above the traces. The plug connector has a front portion that fits into the space between the top wall and circuit board of the receptacle connector, and has a plurality of plug contacts with front portions for engaging the traces. The top wall of the receptacle housing has a row of cam surfaces positioned to depress cam-follower locations on the plug contacts until trace-engaging locations on the plug contacts engage the traces. The plug housing has a plurality of plate-like separators separating the plug contacts, and the top wall of the receptacle has downwardly-depending ribs that are spaced to form slots that receive the spacers, and with the ribs having lower surfaces forming the cam surfaces for depressing the plug contacts. The invention also provides the plug connector with a coax section that includes contacts similar to those for the rest of the connector, but which provide a ground plane and other ground surfaces lying closely beside the signal contact. A pair of ground contacts lie on laterally opposite sides of the signal contact. A grounded tine lies under much of the signal contact.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A receptacle connector for receiving a plug connector, comprising:

a circuit board (32) having an upper face (40) and having a laterally extending row (14) of traces (42) on its upper face;

a receptacle housing (36) which is mounted on said circuit board, said housing including a top wall (44) that lies over said traces, with a space (16) between said top wall and said circuit board being open in a rearwardly-opening direction (R);

said top wall having a plurality of laterally-spaced downward-projecting ribs (72) and forming a plurality of slots (74) with each slot lying between each pair of adjacent ribs;

each of said ribs having a cam surface (120) extending at a downward-forward incline, and said ribs being spaced at the same pitch as said traces with each rib lying directly over one of said traces.

2. The connector described in claim 1 including said plug connector, and wherein:

said plug connector includes a dielectric plug housing (62) with a front end portion (80) that is insertable into said space between said receptacle housing top wall and said circuit board, said front end portion including a plurality of plate-like separators (64) that each lies in a plane that is substantially normal to said lateral direction (L), with said separators fitting into said slots between said ribs of said top wall;

said plug having a plurality of contacts (60) that each has a contact front portion lying between a pair of said separators and being downwardly deflectable by one of said cam surfaces against one of said traces.

3. A plug connector for insertion into a receptacle, comprising:

a plug housing (62) which has a housing front end portion (80) for insertion into the receptacle, said housing front end portion including a plurality of plate-like separators (64) which are laterally spaced apart to leave gaps (140) between adjacent separators with each gap having upper and lower ends (106, 108);

a plurality of contacts (60) mounted on said plug housing, with each of said contacts having a front portion (110) that lies in one of said gaps below the upper end therein and above the lower end therein, and with the extreme front end of each contact also lying within one of said gaps;

said gaps forming spaces above and below each contact front portion, wherein said spaces are open and unobstructed to permit the downward reception of a cam surface (120) into each gap and against a contact front portion lying in the gap and to permit each contact front portion to project below the gap.

4. A method for mating plug and receptacle connectors, wherein said receptacle connector has walls forming a rearwardly-opening cavity (16) with said walls including top and bottom walls (44, 32) with said bottom wall having a laterally-extending row of conductive traces (42) and with said top wall forming a row of camming locations (120) lying over said traces, and wherein said plug connector includes a plug housing (62) with a front end portion (80) and includes a laterally-extending row of plug contacts (60) with contact front portions (110) constructed to enter said cavity, with each contact front portion having a cam follower location (112) positioned to engage one of said camming locations and having a trace-engaging location (114) positioned to engage one of said traces, comprising:

inserting said plug front end portion into said cavity while precisely positioning said plug housing with respect to said cavity walls, and allowing said camming locations to depress said cam follower locations to press said trace-engaging locations against said traces;

said step of precisely positioning includes engaging said plug with said receptacle only by parts of said plug front end portion that lie within said cavity;

said receptacle connector forms a laterally-extending row of vertical ribs (72) with said ribs being laterally spaced to leave walls forming slots (74) between adjacent ribs, and said plug housing includes a laterally-extending row of spacers (64) constructed to pass into said slots;

said step of precisely positioning includes laterally positioning said plug in said cavity by engagement of said separators with said walls of said slots.

5. A coax connector arrangement for engaging ground (221, 223) and signal (222) terminals, comprising:

a ground conductor arrangement which includes a pair of laterally-spaced ground contacts (246, 248) each having a front portion (250) that can be downwardly deflected against one of said ground terminals;

a signal conductor arrangement which includes a signal contact (260) which has a front portion (262) that lies between said ground contact-front portions, said signal contact front portion being downwardly deflectable against said signal terminal.

6. The arrangement described in claim 5 wherein:

said ground conductor arrangement includes an electrically conductive tine which is electrically connected to said ground contact, said tine having a front end lying directly under said signal contact but low enough to avoid touching said signal contact even when said signal contact is downwardly deflected against said terminal.

7. The arrangement described in claim 6 including a coaxial cable having radially inner and outer conductors, and wherein:

said ground conductor arrangement includes a ground plate portion lying in a horizontal plane and having front and rear edges, said ground contacts and said tines each having a rear end, said rear edge of said ground plate portion being connected to said cable outer conductor and said front edge of said ground plate portion merging with rear ends of said ground contacts and of said tine.

8. The arrangement described in claim 7 wherein:

said signal conductor extends forwardly over said ground plate portion;

said ground plate portion has laterally opposite sides and said ground conductor arrangement includes a pair of substantially vertical flanges that project upwardly from said ground plate portion sides at least about as high as a portion of said signal contact that lies over said ground plate portion.

9. The arrangement described in claim 5 including:

a circuit board with an upper face and three laterally spaced traces on said upper face, said traces including a central signal trace and a pair of ground traces on laterally opposite sides of said signal trace;

a dielectric coax frame which has forward walls forming three laterally-spaced coax gaps including a middle coax gap and side coax gaps, with said signal contact front portion lying in said middle coax gap and with said ground contact front portions lying in said side coax gaps;

a housing mounted on said circuit board, said housing having a top wall spaced above said circuit board to leave a space between them for receiving said coax frame forward walls at a position wherein said contact front portions lie directly over said traces, said top wall including cam locations positioned to deflect said contact front portions against said traces.

10. A coax connector arrangement for engaging ground and signal terminals, comprising:

a ground conductor arrangement which includes at least one ground contact having a front portion that can be downwardly deflected against said ground terminal;

a signal conductor arrangement which includes a signal contact which has a front portion that is downwardly deflectable against said signal terminal;

said ground conductor arrangement includes an electrically conductive tine which is electrically connected to said ground conductor, said tine having a front end lying directly under said signal contact but low enough to avoid touching said signal contact even when it is downwardly deflected against said signal terminal.

11. The arrangement described in claim 10 including a coaxial cable having radially inner and outer conductors, and wherein:

said ground conductor arrangement includes a ground plate portion lying under said signal contact and having front and rear edges, said rear edge being connected to said cable outer conductor and said front edge merging with a rear end of said ground contact and with a rear end of said tine.

12. A combination of a receptacle connector and a plug connector, comprising:

a circuit board (32) having an upper face (40) and having a laterally extending row of traces (42) on its upper face;

a receptacle housing (36) which is mounted on said circuit board, said housing including a top wall (44) that lies over said traces and a pair of laterally-spaced side walls (46, 48) supporting said housing on said circuit board, with a space between said top wall and said side walls and said circuit board forming a cavity (16) that is open in a rearwardly-opening direction;

said top wall forming a plurality of laterally-spaced cam surface locations (120) that each extends at a downward-forward incline, and that each lies over one of said traces;

said plug connector includes a dielectric plug housing (62) with a front end portion (80) that is insertable into said cavity, said front end portion including a plurality of laterally spaced walls (64) that form at least one gap (140);

a plurality of contacts (60) mounted on said plug housing, with each of said contacts having a front portion (110) lying in said at least one gap;

spaces above and below said contact front portions being open to permit a cam surface to downwardly depress a contact front portion and to permit each contact front portion to project below the gap to engage one of said traces, but said contact front portions lying completely within said gaps when not deflected so said laterally spaced walls can protect said contact front portions.

13. A plug connector for insertion into a receptacle, comprising:

a plug housing which has a housing front end portion for insertion into the receptacle by movement of the plug housing in a horizontal plane, said plug housing having at least a pair of side walls;

a single row of contacts mounted on said plug housing, with each of said contacts having a front portion with a trace-engaging location (114) with said housing having portions lying both above and below the levels of said contact front portions so no parts of said contact front portions lie above or below or forward of said housing when said contacts are not deflected but with said housing being open below said contact trace-engaging locations.

14. The plug connector described in claim 13 including:

a receptacle comprising a circuit board with a laterally-extending row of traces, and a receptacle housing mounted on said circuit board and having a top wall lying over said traces with the space between said top wall and said circuit board forming a cavity constructed to receive said plug;

said top wall forming a plurality of cam surface locations that each lies over one of said traces and that each extends at a downward-forward incline and that is positioned to depress one of said contacts against one of said circuit board traces.

15. The plug connector described in claim 13 wherein:

each of said contact front portions has a first part (140) extending at an upward-forward incline, a second part (142) forming a bend at an obtuse angle of the front of said first part, a third part (144) extending at a downward-forward incline from said second part and forming said inclined part, and a fourth part (146) lying at the front of said third part and forming a bend with a center lower surface that forms an engaging location (114).

16. The plug described in claim 13 wherein:

each of said contact front portions has a first part (174) extending at a forward-downward incline from said contact middle portion, a second part (180) at the front of said first part with said second part forming a bend with a convex lower surface (182), a third part (184) that extends at a forward-upward incline from said second part and that forms said inclined part, and a fourth part (186) that forms a bend with a convex upper surface at the front end of said third part.

17. The plug described in claim 13 wherein:

said front portion has a substantially horizontal first part (205), a second part (202) that extends in about a 270° loop, a third part (210) that extends at a rearward-downward incline from said loop and that forms said inclined part, and a fourth part (212) that lies at the rear end of said third part and that forms a bend with a convex lower surface (214).

18. A connector system that includes plug and receptacle connectors, where the receptacle connector is of low height, characterized by:

said receptacle connector includes a circuit board having an upper face and a laterally-extending row of conductive traces on said upper face, and said receptacle connector includes a receptacle housing having a top wall lying above said upper face and said traces and having laterally opposite sides, and with said top wall, sides, and circuit board forming a cavity between them;

said plug connector includes a plug housing with a front end portion;

a plurality of plug contacts mounted on said plug housing, with each plug contact having a front portion with an upper cam-follower location and a lower trace-engaging location;

said receptacle housing top wall having a row of cam locations positioned to depress said cam-follower locations to press said trace-engaging locations against said traces;

said plurality of plug contacts includes three plug contacts that are arranged with a middle signal contact (260) lying laterally between two other contacts (246, 248) which are ground contacts, with said ground contacts being electrically connected together and grounded, and including an electrically conductive tine (264) electrically connected to said ground contacts and lying slightly below and out of engagement with said signal contact.

19. A receptacle connector for receiving a plug connector, comprising:

a circuit board (32) having an upper face and having a laterally extending row of traces (42) on its upper face;

a receptacle housing (36) which is mounted on said circuit board, said receptacle housing including a top wall (44) that lies over said traces, with a space (16) between said top wall and said circuit board forming a cavity and being open in a rearwardly-opening direction;

said circuit board has a rear edge (160), and said receptacle housing includes a lip that lies against said board rear edge to protect it, with the thickness of said lip being less than the height (A) of said cavity.

20. The receptacle connector described in claim 19, wherein:

said circuit board is wider than said receptacle housing and projects laterally therefrom, and said housing projects substantially only upwardly from said board.

21. A receptacle connector for receiving a plug connector, comprising:

a circuit board (32) having an upper face (40) and having a laterally extending row (14) of traces (42) on its upper face, said circuit board having a rear edge (160);

a receptacle housing (36) which is mounted on said circuit board adjacent to said rear edge thereof, said housing including a top wall (44) that lies over said traces, with a space (16) between said top wall and said circuit board being open in a rearwardly-opening direction (R);

said top wall having a laterally-spaced row of downward-projecting ribs and having a plurality of cam surfaces that each extends at a downward-forward incline;

said ribs and said cam surfaces being spaced at the same pitch as said traces.

22. A receptacle housing adapted to be mounted on a circuit board having an upper face with a laterally-extending row of spaced traces on said upper face, said receptacle housing comprising:

a top wall adapted to lie over the traces and a pair of laterally-spaced side walls for supporting said housing on the circuit board, with a space between said top wall and said side walls and the circuit board forming a cavity that is open in a rearwardly-opening direction for receiving a plug connector;

said top wall having a lower surface forming a plurality of laterally-spaced ribs and a plurality of slots between adjacent one of said ribs, with the lateral spacing of said ribs and of said slots each equal to the lateral spacing of said traces, and said top wall lower surface also forms cam surface locations that each extends at a downward-forward incline, said cam surface locations being laterally spaced apart by the spacing of said traces.

23. The receptacle housing described in claim 22 wherein:

said ribs have lower surfaces forming said cam surface locations.

24. The receptacle housing described in claim 22 wherein:

said spaced traces on the board lie adjacent to an edge of the board;

said side walls of said housing have rear portions; and a lip that extends laterally between said rear portions of said side walls so as to lie against the board edge to protect it.

25. The receptacle housing described in claim 24 wherein:

the upper rear edge of said lip is formed with a bevel to facilitate insertion of the plug connector into said cavity.

26. The receptacle housing described in claim 22 in combination with said plug connector, and wherein:

said plug connector includes a dielectric plug housing with a front end portion that is insertable into said cavity, said front end portion including a plurality of laterally-spaced separators that form gaps between adjacent separators;

a plurality of contacts mounted on said plug housing, with each of said contacts having a front portion lying in one of said gaps, and said contact front portions lying completely within said gaps when said contacts are undetected;

the spaces above and below said contact front portions being open to permit said cam surface locations on said receptacle housing top wall to downwardly depress said contact front portions and to permit said contact front portions to project below the gaps to engage the traces on the circuit board when said plug connector is mounted in said cavity.

* * * * *